United States Patent [19]

Eakin

[11] 4,079,592

[45] Mar. 21, 1978

[54] METHOD OF AND APPARATUS FOR FEEDING AND INSERTING BOLTS IN A MINE ROOF

[75] Inventor: Robert Nelson Eakin, Belle Mead, N.J.

[73] Assignee: The United States of America as represented by the Secretary of the Interior, Washington, D.C.

[21] Appl. No.: 774,355

[22] Filed: Mar. 4, 1977

[51] Int. Cl.[2] ..... E21D 20/02; E21D 21/00

[52] U.S. Cl. ..... 61/45 B; 61/63

[58] Field of Search ..... 61/45 B, 39, 63, 84, 61/85; 299/10, 11

[56] References Cited

U.S. PATENT DOCUMENTS

| | | | |
|---|---|---|---|
| 3,324,663 | 6/1967 | Mclean | 61/45 B X |
| 3,332,244 | 7/1967 | Mclean | 61/45 B X |
| 3,436,923 | 4/1969 | Lagerstrom | 61/39 X |
| 3,541,797 | 11/1970 | Stewart | 61/45 B X |
| 3,665,717 | 5/1972 | Sweeney et al. | 61/39 |
| 3,861,155 | 1/1975 | Steinberg et al. | 61/45 B |
| 3,913,338 | 10/1975 | Galis | 61/45 B |

*Primary Examiner*—Dennis L. Taylor

*Attorney, Agent, or Firm*—Thomas Zack; Donald A. Gardiner

[57] ABSTRACT

In an apparatus for installing resin anchored roof bolts in a mine roof, continuous bolt material is stored on a spool rotatably mounted on a mobile roof bolter frame. As the apparatus advances along the mine passageway, the bolt material is uncoiled from the spool and guided upwardly into spaced apart, resin filled holes that are preformed in the mine roof. The bolt material is severed just beneath the roof at each hole to form a unitary roof bolt. A stop is formed in the unitary bolt with a hydraulically operated head and mandrel mechanism that makes a right angle bend in the bolt just beneath the mine roof.

5 Claims, 5 Drawing Figures

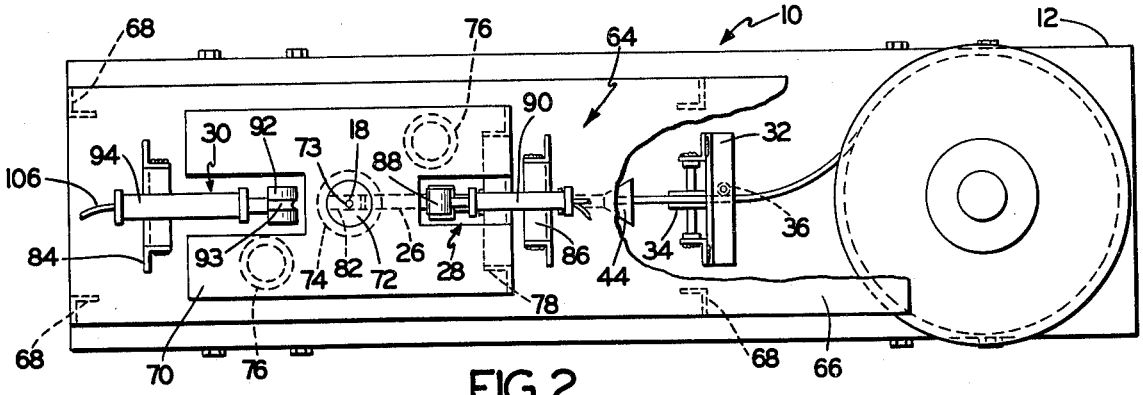
FIG.2
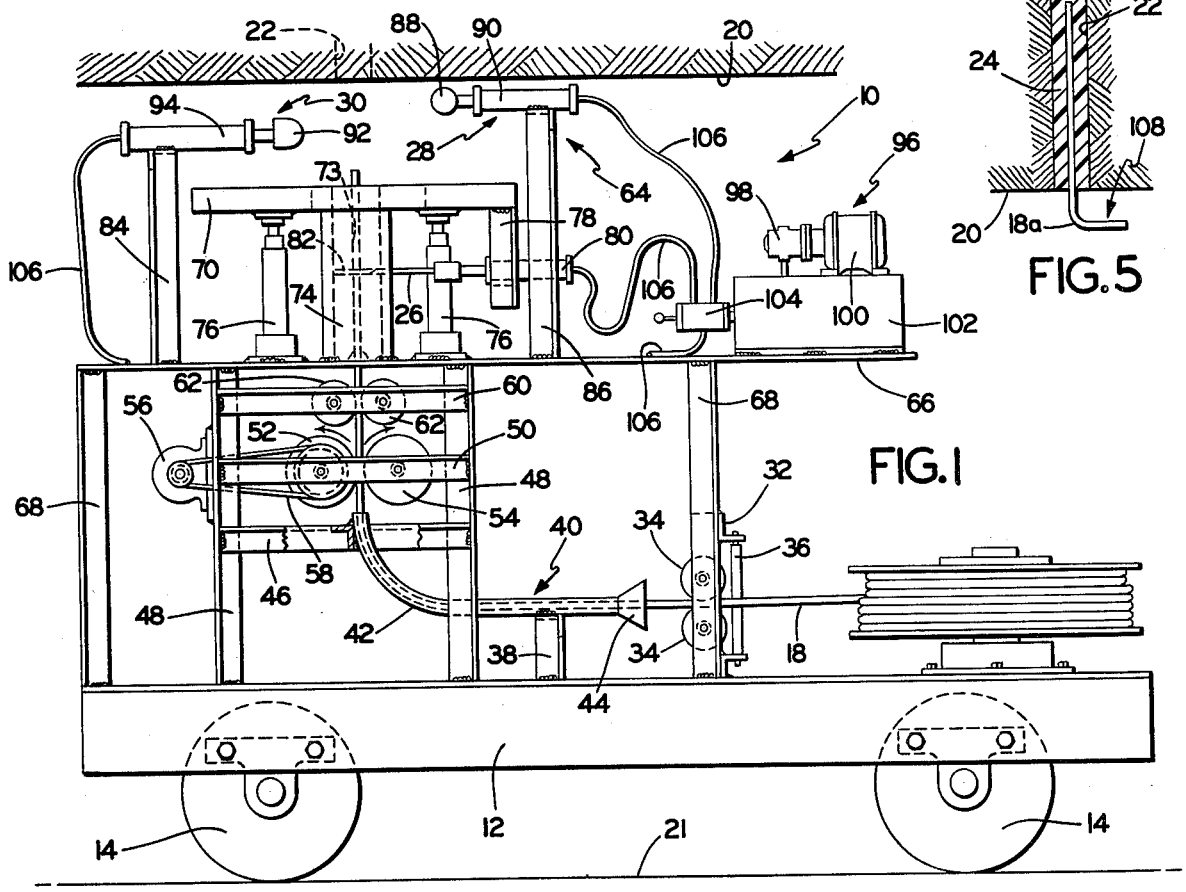
FIG.1
FIG.5
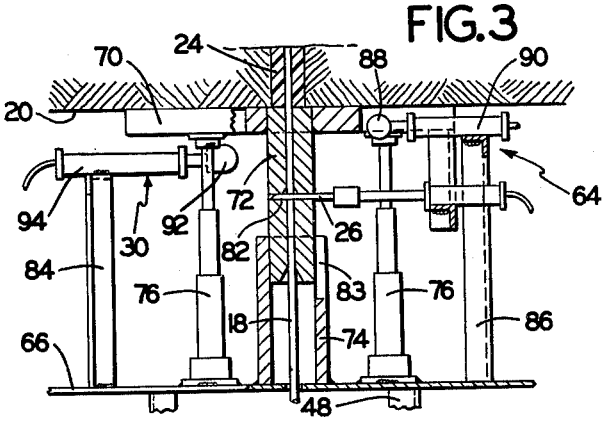
FIG.3
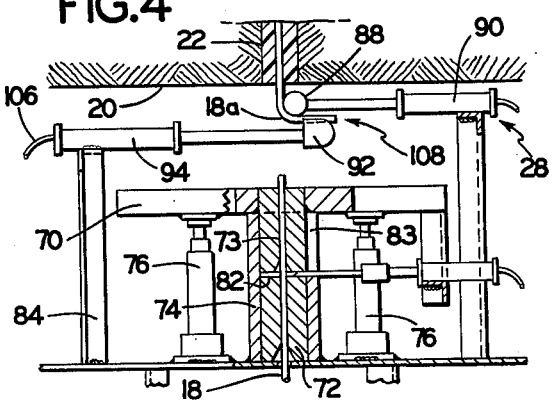
FIG.4

METHOD OF AND APPARATUS FOR FEEDING AND INSERTING BOLTS IN A MINE ROOF

BACKGROUND OF THE INVENTION

The present invention relates generally to methods of and apparatus for reinforcing mine roofs, and more particularly, toward a method of and apparatus for feeding and inserting roof bolts into resin filled holes preformed in the roof.

Mine roof failures are often caused by the natural tendency of rock strata to flow into the void created by removal of coal. As the flow occurs, it creates a separation of the various levels of rock strata, contributing to failure or collapse of the roof, thereby jeopardizing the lives of personnel working in the underground mine.

The purpose of the rock bolt support system is to resist strata movement in order to provide safer working conditions. The rock bolt supporting system of the prior art uses elongated roof bolts usually a few feet in length which are inserted into openings drilled in the strata above the roof of a mine passageway at predetermined, spaced apart intervals. The bolts conventionally include some type of anchor-like fastening means at one end adjacent the uppermost part of the hole, and a stop at the opposite end of the bolt to place the bolt under tension. By this arrangement, the strata above the roof are compressed in a vertical direction to bind together thinly banded rock layers.

The effectiveness of these bolts depends on the tension applied between the bolt head and the anchored end. The bolt must also penetrate sufficient strata in order to achieve reliable anchorage; if the anchor is located in soft areas of strata above the roof, the anchor slips and the roof sags or bulges in the area between the bolts.

A recently developed system for reinforcing mine roofs involves anchoring the roof bolts in resin filled holes formed in the roof. The resin anchors the entire length of the roof bolt to surrounding strata. As a result, the system does not depend solely on rock strata for anchorage, because the resin forms a bond between the bolt and all of the surrounding rock strata. Since the bolt is not limited to anchorage at a single point, there is no requirement for single point anchorage between the opposite ends of the bolt. Further, the unification of the resin, bolt and strata provides the necessary strength and rigidity to prevent sag by acting as a reinforcement which anchors the individual stratified layers of rock into a single, high strength beam.

Heretofore, the resin filled bolt system has been installed by drilling spaced apart holes into the roof and filling the holes with resin. Then, at each hole, the full length of a unitary, premanufactured roof bolt is inserted and held momentarily in place as the resin sets.

The application of individual roof bolts into the resin filled holes has been found to be undesirably time consuming. It is necessary to apply the roof bolts to the resin filled holes as quickly as possible in order to (1) increase production rates, and (2) minimize shifting in rock strata after the holes have been drilled but before bolts have been applied. In a resin anchored bolt system, there presently exists a need for a method of and apparatus for rapidly inserting roof bolts into resin filled holes preformed in the mine roof.

Accordingly, one object of the present invention is to provide a new and improved method and apparatus for reinforcing mine roofs.

Another object is to provide a new and improved method of and apparatus for feeding roof bolts into resin filled holes preformed in a mine roof.

Another object is to provide a new and improved method of and apparatus for rapidly feeding and inserting roof bolts into resin filled holes in a mine roof.

Yet another object is to provide a new and improved method of and apparatus for reinforcing a mine roof, wherein handling of individual roof bolts is not required.

SUMMARY OF THE INVENTION

In accordance with the invention, in a resin anchored roof bolting system, continuous bolt material, such as steel cable, is stored on a spool rotatably mounted on a mobile frame. As the frame advances along the mine passageway into position beneath each of a series of resin filled holes preformed in the mine roof, bolt material is uncoiled from the spool and guided upwardly toward the roof. The bolt material is inserted into a resin filled hole and secured just beneath the roof to form a unitary bolt. A stop is then provided by making a right angle bend in the bolt at the end thereof extending outside the resin filled hole.

The spool is mounted on the mobile frame about a vertical axis. The cable is guided from the spool along a right angle so as to be normal to the roof by pairs of guide rolls at opposite ends of a length of right angle tubing. A drive roll, positioned between the tubing and mine roof, drives the cable upwardly for insertion into the resin filled hole.

A pressure plate mounted to a pair of hydraulic jacks on the frame is provided to be moved into contact with the roof so as to maintain the frame steady and in proper position during insertion of bolt material into the resin filled hole. A cut-off blade mounted on the frame beneath the pressure head is indexed by a hydraulic cylinder to sever the bolt material after insertion into the resin filled hole to form a unitary bolt.

A mandrel and forming head mechanism is positioned just beneath the roof to form the right angle bend constituting the stop in the unitary bolt. The mandrel and forming head mechanism is operated by hydraulic cylinders to come into contact with the exposed end of the bolt and make the right angle bend following severing of the bolt material.

In operation, as the frame is moved along the mine passageway, the frame is located in proper position to each preformed, resin filled hole, and the pressure plate is raised into contact with the mine roof. A length of the bolt material is uncoiled from the spool by the drive roll and inserted into substantially the full depth of the resin filled hole. After the bolt material has been seated in the resin filled hole, the cut-off blade is indexed to sever the material so as to form a unitary roof bolt. The pressure plate is now lowered, and the mandrel and forming head mechanism is operated to form the right angle bend at the exposed end of the bolt.

The right angle bend, or stop, formed in the end of the roof bolt does not function as an anchor or tension point for the roof since the resin and bolt system anchors to rock strata throughout the entire length of the hole. As a result, initial tensioning and subsequent rechecking of tension are not required.

Prior art systems of which we are aware, wherein bolts or anchors are stored on spools during manufacture of the bolts or during application to rock are disclosed in U.S. Pat. Nos. 3,301,123 to Worley and 3,436,923 to Lagerstrom. However, neither patent discloses a system for feeding and inserting roof bolts into resin filled holes by uncoiling continuous roof bolt material from a spool on location, severing and bending the material as needed to form unitary bolts after insertion into the mine roof.

Other objects, advantages and features of the present invention will become readily apparent to those skilled in this art from the following detailed description, wherein we have shown and described only the preferred embodiment of the invention, simply by way of illustration of the best mode contemplated by us of carrying out our invention. It is to be understood that the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWING

FIG. 1 is a side elevation view of a roof bolter apparatus having incorporated therein a resin anchored bolt feeder system, in accordance with the present invention;

FIG. 2 is a plan view of the apparatus shown in FIG. 1 with a portion broken away to expose a set of guide rolls;

FIG. 3 is a side elevation view of the apparatus shown in FIG. 1 with the pressure head positioned against the roof during severing of roof bolt material to form a unitary bolt;

FIG. 4 shows the pressure head in a retracted position with the mandrel and forming head assembly forming a stop in the exposed end of the roof bolt; and FIG. 5 is a cross sectional view of a completed unitary roof bolt in accordance with the invention positioned in a resin filled hole.

DETAILED DESCRIPTION OF A PREFERRED EMBODIMENT

Referring to FIG. 1, a roof bolter apparatus 10, provided in accordance with the invention and used in conjunction with a resin anchored bolt system, comprises a frame 12 mounted on wheels 14 so as to be transportable along the floor 21 of a mine passageway. Rotatably supported on the frame 12 is a spool 16 on which is wound or stored continuous bolt material 18. The bolt material 18 is in the form of a continuous cable or rod formed of steel and somewhat flexible to the extent that it can be coiled onto the spool 16.

In order to reinforce mine roof 20, a series of holes 22 each being several feet on depth is drilled into mine roof 20 at predetermined, spaced apart intervals. The holes are filled with a polyester resin, such as Mylar. Mylar is a Registered Trademark identifying a family of polyester resins manufactured by du Pont. The resin filled holes 22 are formed in roof 20 using a mine roof drilling apparatus mounted on the frame 12 or on a separate mobile apparatus.

Apparatus for forming resin filled holes in a mine roof do not constitute the present invention, and are therefore not described herein. However, in accordance with the present invention, roof bolt material 18 is uncoiled from spool 16 on the mobile frame 12, and is guided upwardly to be inserted into a resin filled hole preformed in mine roof 20. As described in detail below, with the bolter frame 12 located in proper position under each resin filled hole 22 in roof 20, the upper end of the roof bolt material 18 is inserted into substantially the entire depth of the hole. The bolt material 18 is severed just beneath mine roof 20 by cut-off blade 26 to form a unitary bolt. Then, the exposed end of the bolt is formed at a right angle constituting a stop by mandrel 28 and forming head 30.

As will become apparent, highly efficient rates of production are possible using the apparatus 10, and since it is not necessary to handle the individual bolts on location in the mine. Roof bolter 10 is more compact than prior art roof bolter apparatus, and a larger number of roof bolts can be installed between reloads. In addition, since the unitary roof bolts are cut to length on location, the length of the bolts can be adjusted to accomodate requirements found to exist within the mine.

Mounted on frame 12 adjacent spool 16 is a bracket 32 supporting a pair of opposed guide rolls 34 between which bolt material 18 is guided. A vertical rod-shaped roll 36 is also supported on bracket 32 and serves to retain the bolt material 18 transversely aligned to the guide rolls 34.

Downstream of guide rolls 34 and mounted on frame 12 is a vertical spacer member 38 supporting a guide sleeve 40. The sleeve 40 is gently curved at a right angle, as shown, and includes a tubular section 42 in which is slidably contained the bolt material 18. An end flange or lip 44 is located on one end of the section 42 to facilitate threading of the bolt material into the sleeve. The opposite end of tubular section 42 is secured to a frame member 46, carried by vertical legs 48 with the body of the tubular section 42 extending toward spool 16 along a horizontal plane.

Also mounted to legs 48 is a second frame member 50 to which are rotatably mounted a drive roll 52 and a cooperating roll 54. Bolt material 18 extending outwardly from the sleeve 40 is guided between the rolls 52 and 54. As drive roll 52 is rotated counterclockwise (see arrow in FIG. 1), frictional contact between rolls 52 and 54 and the bolt material 18 is sufficient to cause the bolt material to be driven upwardly as it is uncoiled from spool 16.

Mounted to one side of leg 48 adjacent drive roll 52 is a motor 56 operatively connected to the drive roll with a belt 58. During a roof bolt forming cycle, motor 56 rotates the 52 counterclockwise so as to uncoil the bolt material 18 from spool 16 to extend the bolt material into the resin filled hole 22 formed in mine roof 20. During each cycle, the motor 56 is operated for a time sufficient to pay out a sufficient length of bolt material 18 from spool 16 to extend the bolt material into the hole 22 to a predetermined depth, preferably substantially the entire length of the hole. The motor 56 is controlled by a conventional timing mechanism (not shown) for this purpose, and can be programmed on location to accomodate different bolt lengths, as required.

Located above rolls 52 and 54 on an additional frame member 60 are a second pair of guide rolls 62 between which the bolt material 18 is driven by the rolls 52 and 54. The bolt material 18 is thus guided by rolls 62 upwardly into resin filled hole 22 through a mechanism mounted above frame 12 and indicated generally at 64 for severing the bolt material and forming the right angle bend or stop therein.

Mechanism 64 is mounted on a horizontal platform 66 supported above frame 12 by a set of four vertical legs 68. The mechanism 64 includes a horizontal pressure plate 70 centrally mounted on a piston 72 located within a stationary cylinder 74. An axial throughbore 73 is formed in piston 72 through which is contained the bolt material 18. Also formed in the piston 72 is a radial slot 82 through which the cut-off blade 26 for severing bolt material 18 is extended.

Also located on the platform 66 on opposite sides of cylinder 74 are a pair of hydraulic jacks 76 for raising the pressure plate 70 into contact with mine roof 20. The jacks 76 are located on opposite corners of plate 70 (FIG. 20) to ensure that uniform pressure be applied to mine roof 20.

At one end of pressure plate 70, there is located a downwardly extending bracket 78 for supporting a hydraulic cylinder 80 as well as cut-off blade 26. The cylinder 80 and blade 26 are fixed in position relative to the pressure plate 70 so that the cylinder and blade are indexed upwardly along with the plate during operation of hydraulic jacks 76 to apply the pressure plate 70 against roof 20. Thus, when pressure plate 70 is indexed upwardly into contact with mine roof 20, cut-off blade 26 is in proper position to sever the bolt material 18 in the formation of a unitary roof bolt. A vertical slot 83 (FIG. 3) formed in cylinder 74 for receiving blade 26 permits the blade to index along with plate 70 without interference with the cylinder wall.

Mandrel 28 and forming head 20 are supported above the horizontal platform 66 on vertical support members 84 and 86, respectively. Mandrel 28 comprises a cylindrical head 88 carried by a hydraulic cylinder 90 so as to be indexable toward and into contact with a portion of bolt material 18 extending outside resin filled hole 22. The head 92 has provided therein a spline or groove 93 in which bolt material 18 is seated while the right angle stop is being formed. Similarly, the forming head 30 comprises a head 92 carried by another hydraulic cylinder 94 and indexable into contact with a portion of bolt material 18 just below mandrel head 88.

Hydraulic cylinders 90 and 94 and pressure plate piston 72, as well as jacks 76, are operated by a conventional source 96 of hydraulic pressure which includes a pump 98 driven by a motor 100, both of which are mounted on tank or reservoir 102, in turn mounted on platform 66. At the outlet of tank 102 is positioned a conventional control valve 104 for controlling hydraulic pressure to lines 106 in order to operate the pressure plate piston 72, the hydraulic cylinders 90 and 94, and jacks 76, in a manner described below.

It can now be appreciated that apparatus 10 both manufactures and installs roof bolts into resin filled holes 22 in a mine roof by transporting continuous bolt material 18 wound on spool 16 to the preformed resin drilled holes 22, uncoiling bolt material from the spool to an appropriate length, guiding the bolt material upwardly into each resin filled hole 22, severing the bolt material just beneath the mine roof 20 to form a unitary bolt 18*a*, and forming a right angle stop in the exposed end of the unitary bolt.

In the operation of the mine roof bolter apparatus 10, referring again to the Figures, the bolter apparatus is advanced within the mine passageway into proper position with respect to each of the resin filled holes 22 preformed in mine roof 20. With the upper end of bolt material 18 positioned directly below a hole 22, pressure plate 70 is extended upwardly by jacks 76 into contact with mine roof 20, and sufficient pressure is applied to the roof to retain the apparatus 10 in a stable position between the roof 20 and the floor 21. Motor 56 is now energized to rotate the drive roll 52 which, in cooperation with roll 54, causes the bolt material 18 to travel upwardly between guide rolls 62 through the axial throughbore 73 formed in the pressure plate piston 72. As bolt material 18 is uncoiled from the spool 16, material is guided between rolls 34 and guide sleeves 40 to orient the material vertically, and between guide rolls 44 toward the resin filled hole 22.

When a sufficient length of bolt material 18 has been uncoiled from spool 16 whereby the bolt material extends into resin filled hole 22 along substantially the entire depth of the hole, hydraulic cylinder 80 is operated to extend cut-off blade 26 through the radial slot 82 formed in piston 72 to sever the bolt material 18 as shown in FIG. 3. The pressure plate 70 is then returned to the lower position as shown in FIG. 4. The bolt material now seated in hole 22 with an exposed portion extending downwardly therefrom, is identified by the character 18*a*.

Still referring to FIG. 4, hydraulic cylinder 90 is operated to extend mandrel head 88 into contact with the exposed portion 107 of unitary bolt 18*a*. With the bolt 18*a* in contact with mandrel head 88, hydraulic cylinder 94 is operated to extend the forming head 92 into contact with the bolt 18*a* just beneath mandrel head 88, and a sufficient amount of force is applied by the forming head against the bolt to loop the the end of the bolt along a right angle as shown in FIG. 4 in order to form a stop. As the forming head 92 bends the end of bolt 18*a* around mandrel head 88, the bolt is seated in groove 93 on the head 92 to prevent lateral slipping. Finally, hydraulic cylinders 90 and 94 are operated to retract the heads 88 and 92 for readiness for another operating cycle.

The stop 108 (FIG. 5) is located slightly beneath the mine roof 20. The purpose of the stop 108 is to increase headroom in the mine passageway and may also serve as a gripping part for making any positional adjustments in the bolt 18*a* before the resin sets. The stop 108 does not function as an anchor for the roof surface because, as described above, the resin and bolt system is effectively anchored to the rock strata along the entire length of the bolt and competant support is obtained even in soft shale.

In this disclosure there is shown anbd described only the preferred embodiment of the invention, but, as aforementioned, it is to be understood that the invention is capable of other and different embodiments, and its several details capable of use in other environments, all without departing from the inventive concept as expressed herein.

What is claimed is:

1. An apparatus for feeding bolts into resin filled holes in a mine roof, comprising:

a mobile frame;

a spool rotatably mounted on said frame for storing continuous bolt material;

means for uncoiling the bolt material from said spool and for guiding said material into a resin filled hole preformed in the mine roof;

means for severing said bolt material adjacent said mine roof to form a unitary roof bolt; and means for forming a stop in said unitary bolt at an end thereof extending outwardly from said resin filled hole, said means including means for forming a right angle bend in an end of said roof bolt material extending outside said hole, said means including a mandrel for contacting a portion of said unitary roof bolt extending outside said hole, and a cooperating forming head below said mandrel for bending said roof bolt material around said mandrel.

2. The apparatus of claim 1, wherein said head is controlled by a hydraulic cylinder.

3. A method of feeding roof bolts into preformed resin filled holes in a mine roof using continuous mine roof bolt material wound on a spool, comprising the steps of:

(a) preforming a resin filled hole in a mine roof;

(b) positioning a spool carrying roof bolt material in proximity to said preformed resin filled hole;

(c) uncoiling a length of the bolt material from said spool;

(d) guiding the free end of the uncoiled bolt material into said resin filled hole a sufficient distant to provide a resin anchored roof bolt along substantially the entire length of said bolt in the hole; and (e) thereafter severing the bolt material adjacent the roof to form a unitary roof bolt.

4. The method of claim 3, including the step of forming a stop on the unitary bolt at the severed end thereof extending outside said hole.

5. The method of claim 4, wherein said forming step includes the step of forming a right angle bend in said unitary bolt at said severed end.

* * * * *